US012202655B2

(12) United States Patent
Lee

(10) Patent No.: US 12,202,655 B2
(45) Date of Patent: Jan. 21, 2025

(54) DRAWER BOX

(71) Applicant: Samsung Electronics Co., Ltd., Suwon-si (KR)

(72) Inventor: Youngchae Lee, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 0 days.

(21) Appl. No.: 18/138,531

(22) Filed: Apr. 24, 2023

(65) Prior Publication Data

US 2023/0257158 A1 Aug. 17, 2023

Related U.S. Application Data

(63) Continuation of application No. PCT/KR2022/010566, filed on Jul. 20, 2022.

(30) Foreign Application Priority Data

Aug. 26, 2021 (KR) ..... 10-2021-0113245
Sep. 14, 2021 (KR) ..... 10-2021-0122595

(51) Int. Cl.
*B65D 5/38* (2006.01)
*B65D 5/478* (2006.01)
(Continued)

(52) U.S. Cl.
CPC ..... *B65D 5/38* (2013.01); *B65D 5/46056* (2013.01); *B65D 5/48026* (2013.01); *B65D 5/5038* (2013.01)

(58) Field of Classification Search
CPC .. B65D 5/38; B65D 5/46056; B65D 5/48026; B65D 5/5038; A45C 2011/001; A45C 2011/002; A45C 2011/003
(Continued)

(56) References Cited

U.S. PATENT DOCUMENTS 4,585,124 A 4/1986 Pride
6,270,006 B1 8/2001 Bright et al.
(Continued)

FOREIGN PATENT DOCUMENTS

DE 2422148 A1 11/1975
EP 1584565 A1 10/2005
(Continued)

OTHER PUBLICATIONS

International Search Report and Written Opinion for International Application No. PCT/KR2022/010566; International Filing Date Jul. 20, 2022; Date of Mailing Nov. 10, 2022; 46 pages.
(Continued)

*Primary Examiner* — Jacob K Ackun
(74) *Attorney, Agent, or Firm* — CANTOR COLBURN LLP

(57) ABSTRACT

A box according to an embodiment includes a first case including a first opening in at least one surface thereof, a second case inserted into the first case through the first opening, a partition wall configured to partition an interior of the first case into an area into which the second case is inserted and a remaining area, and a string which has one end coupled to the partition wall and which is configured such that when the second case is inserted into the first case, a part thereof is inserted into the first case and a part of a remainder thereof is exposed at an outside of the first case, wherein at least a part of the second case is withdrawn from the first case by the part of the remainder thereof being pulled in a state in which the second case is inserted in the first case.

20 Claims, 23 Drawing Sheets

(51) Int. Cl.
*B65D 5/49* (2006.01)
*B65D 5/50* (2006.01)

(58) Field of Classification Search
USPC ..... 206/320, 576, 804
See application file for complete search history.

(56) References Cited

U.S. PATENT DOCUMENTS

| | | | | |
|---|---|---|---|---|
| 7,876,558 | B2 * | 1/2011 | Daley, III | G06F 1/1628 361/679.55 |
| 8,997,983 | B2 * | 4/2015 | Sajid | G06F 1/1628 206/320 |
| 9,027,750 | B1 * | 5/2015 | Ehrlich | F16M 11/041 206/320 |
| 9,104,377 | B2 * | 8/2015 | Rekuc | A45F 3/02 |
| 10,466,794 | B2 | 11/2019 | Maeda et al. | |
| 11,713,157 | B2 | 8/2023 | Cernokus et al. | |
| 11,800,667 | B2 | 10/2023 | Oh et al. | |
| 2008/0179384 | A1 | 7/2008 | Diaz De La Rocha | |
| 2011/0011759 | A1 * | 1/2011 | Luo | A45C 15/06 206/320 |
| 2012/0118768 | A1 * | 5/2012 | Boland | B65D 85/42 206/320 |
| 2012/0241330 | A1 * | 9/2012 | Still | A45C 11/00 206/45.24 |
| 2013/0062344 | A1 | 3/2013 | Kim et al. | |
| 2020/0136231 | A1 | 4/2020 | Lee et al. | |
| 2020/0333855 | A1 | 10/2020 | Kim et al. | |

FOREIGN PATENT DOCUMENTS

| | | | |
|---|---|---|---|
| JP | H0642638 | | 6/1994 |
| JP | 2001158421 | A | 6/2001 |
| JP | 2001171651 | A | 6/2001 |
| JP | 2004210370 | A | 7/2004 |
| JP | 2014186361 | A | 10/2014 |
| KR | 200411910 | Y1 | 3/2006 |
| KR | 200429275 | Y1 | 10/2006 |
| KR | 20070000669 | U | 6/2007 |
| KR | 100840840 | B1 | 6/2008 |
| KR | 20100010918 | U | 11/2010 |
| KR | 20100012894 | U | 12/2010 |
| KR | 20130027713 | A | 3/2013 |
| KR | 200474424 | Y1 | 9/2014 |
| KR | 20180068081 | A | 6/2018 |
| WO | 0134003 | A1 | 5/2001 |
| WO | 2020122598 | A1 | 6/2020 |

OTHER PUBLICATIONS

European Search Report Issued In EP Application No. 22796184.4-1201, Mail Date Aug. 22, 2024, 10 Pages.
European Search Report Issued In EP Application No. 22861556.3-1214, Mail Date Sep. 25, 2024, 9 Pages.

* cited by examiner

DRAWER BOX

CROSS-REFERENCE TO RELATED APPLICATION(S)

This application is a continuation application, claiming priority under § 365(c), of an International application No. PCT/KR2022/010566, filed on Jul. 20, 2022, which is based on and claims the benefit of a Korean patent application number 10-2021-0122595, filed on Sep. 14, 2021, in the Korean Intellectual Property Office, and of a Korean patent application number 10-2021-0113245, filed on Aug. 26, 2021, in the Korean Intellectual Property Office, the disclosure of which is incorporated by reference herein in its entirety.

TECHNICAL FIELD

Various embodiments disclosed herein relate to a type of a drawer box of an electronic device.

BACKGROUND ART

An electronic device such as a mobile phone may need a box for packing the product. The box may facilitate loading and to secure loading stability. In addition, the box may be used to safely transport the electronic device to a designated location in the process of distributing the electronic device, thereby preventing damage to the electronic device.

The box may include a type of a drawer box that is configured such that a second case disposed in a first case is moved out of the first case or moved into the first case in a sliding door type. The second case contains the product, and the user can unload the product after moving the second case out of the first case.

DISCLOSURE

Technical Problem

It may be necessary to apply an external force to the second case such that the second case is moved out of the first case. In this case, an element may be provided to play the role of a handle for applying an external force to the second case. A problem may exist, however, in that the second case or the handle part may be broken by the external force.

Technical Solution

A box according to various embodiments of the disclosure may include a first case including a first opening in at least one surface thereof, a second case inserted into the first case through the first opening, a partition wall configured to partition an interior of the first case into an area into which the second case is inserted and a remaining area, and a string which has one end coupled to the partition wall and which is configured such that when the second case is inserted into the first case, a part thereof is inserted into the first case and a part of a remainder thereof is exposed at an outside of the first case, wherein at least a part of the second case is withdrawn from the first case by the part of the remainder thereof being pulled in a state in which the second case is inserted in the first case.

A box assembly process according to various embodiments of the disclosure may include disposing a partition wall in an interior of a first case including a first opening in at least one surface thereof, coupling a string to the partition wall, and inserting a second case into the first case such that when the second case is inserted through the first opening of the first case, a part of the string is inserted into the first case, and a part of a remainder thereof is exposed outside the first case.

Advantageous Effects

According to various embodiments disclosed herein, damage occurring when a user moves a case out of a package may be prevented. In addition, the user may easily move the case out of the package.

Various other advantageous effects identified explicitly or implicitly through the disclosure may be provided.

DESCRIPTION OF DRAWINGS

In connection with the description of the drawings, same or similar reference numerals will be used to refer to same or similar elements.

MODE FOR INVENTION

Figure 1:
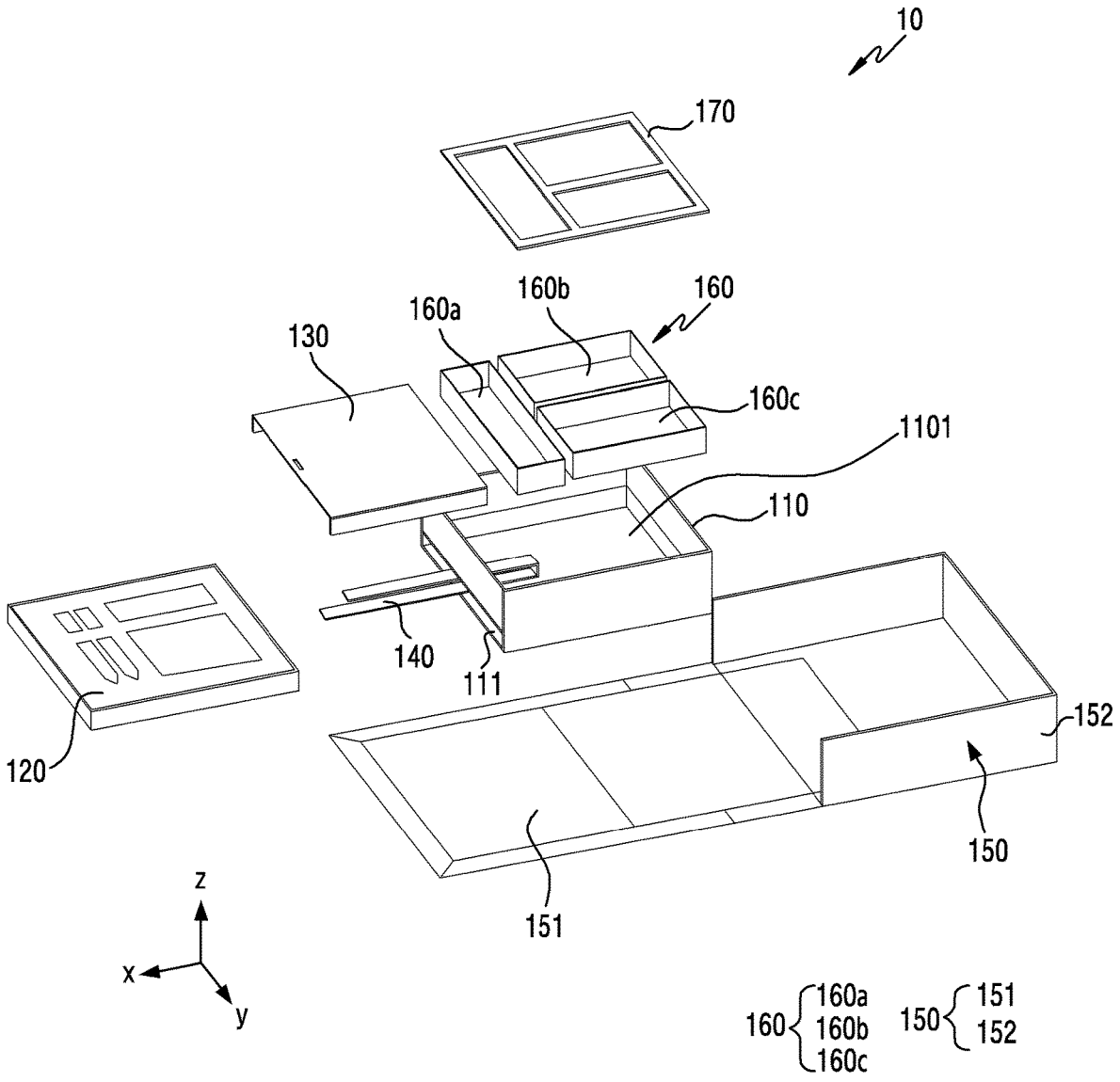
FIG. 1 is an exploded perspective view of a box according to an embodiment.

Hereinafter, various embodiments of the disclosure will be described with reference to the accompanying drawings. However, it should be appreciated that the described embodiments are not intended to limit the disclosure to particular embodiments, and the disclosure should be construed to cover various modifications, equivalents, and/or alternatives of the embodiments.

An electronic device according to various embodiments of the disclosure may include at least one of, for example, a smartphone, a tablet personal computer (PC), a mobile phone, a video phone, an electronic book reader (e-book reader), a desktop PC, a laptop PC, a netbook computer, a workstation, a server, a personal digital assistant (PDA), a portable multimedia player (PMP), a MPEG-1 audio layer-3 (MP3) player, a mobile medical device, a camera, and a wearable device. The wearable device may include at least one of an accessory type (e.g., watch, ring, bracelet, anklet, necklace, glasses, contact lens, or head-mounted device (HMD)), a fabric or clothing-integrated type (e.g., electronic clothing), a body-mounted type (e.g., skin pad, or tattoo), and a bio-implantable type (e.g., implantable circuit).

In some embodiments, the electronic device may include at least one of, for example, a television, a digital video disk (DVD) player, an audio, a refrigerator, an air conditioner, a vacuum cleaner, an oven, a microwave oven, a washing machine, an air purifier, a set-top box, a home automation control panel, a security control panel, a TV box, a game console, an electronic dictionary, an electronic key, a camcorder, and an electronic photo frame.

In other embodiments, the electronic device may include at least one of various medical devices (e.g., various portable medical measuring devices (blood glucose monitoring device, heart rate monitoring device, blood pressure measuring device, body temperature measuring device, etc.), magnetic resonance angiography (MRA), magnetic resonance imaging (MRI), computed tomography (CT) machine, ultrasonic machine, etc.), a navigation device, a global positioning system (GPS) receiver, an event data recorder (EDR), a flight data recorder (FDR), a vehicle infotainment device, electronic equipment for a ship (e.g., ship navigation device, gyro-compass, etc.), avionics, a security device, an automobile head unit, a home or industrial robot, an automatic teller's machine (ATM) in banks, point of sales (POS) in a shop, or Internet of things devices (e.g., light bulb, various sensors, electric or gas meter, sprinkler device, fire alarm, thermostat, streetlamp, toaster, sporting goods, hot water tank, heater, boiler, etc.).

According to some embodiments, the electronic device may include at least one of a part of furniture or a building/structure, an electronic board, an electronic signature receiving device, a projector, and various kinds of measuring instruments (e.g., water meter, electric meter, gas meter, radio wave meter, etc.). In various embodiments, the electronic device may be a combination of one or more of the aforementioned various devices. According to some embodiments, the electronic device may a flexible electronic device. Further, the electronic device according to an embodiment of the disclosure is not limited to the aforementioned devices, and may include a new electronic device according to the development of technology.

Figure 2:
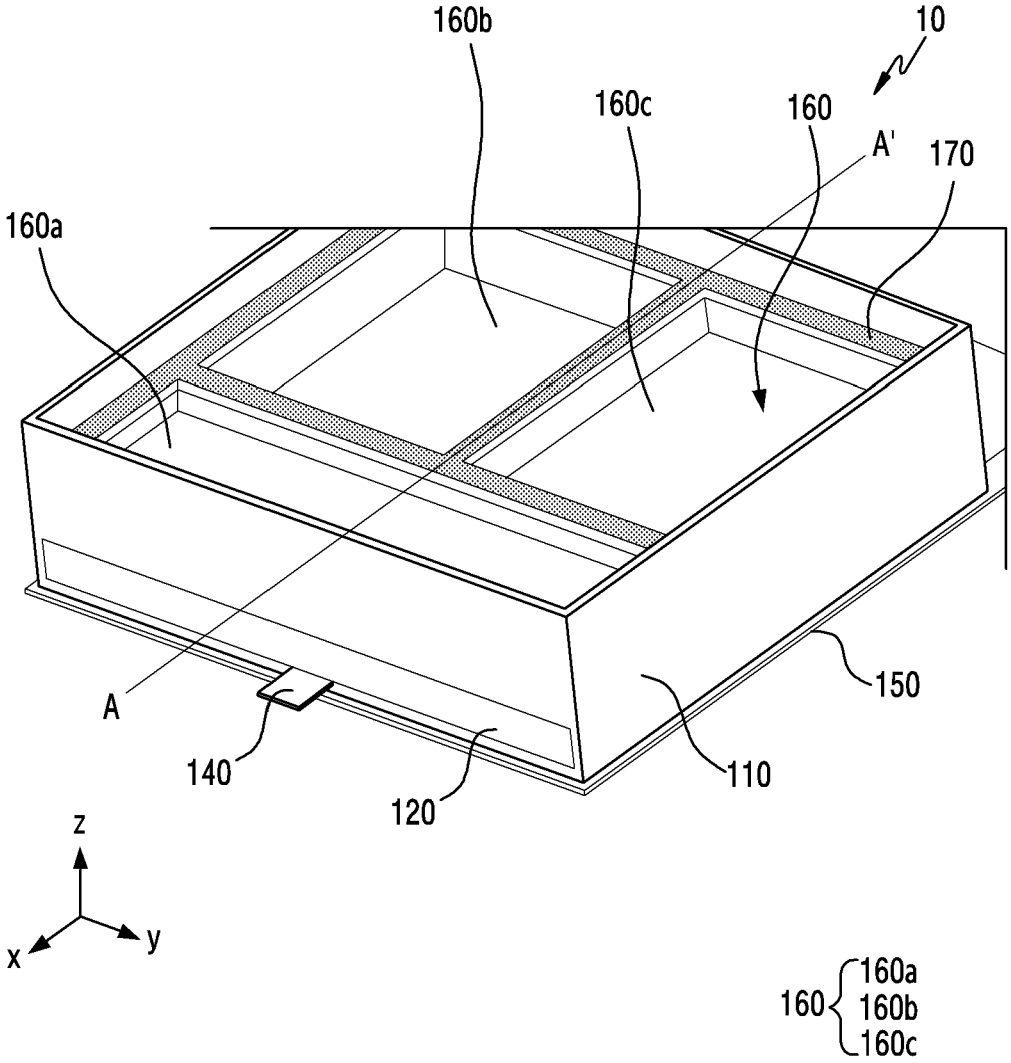
FIG. 2 is a perspective view of a box according to an embodiment.

FIG. 1 is an exploded perspective view of a box 10 according to an embodiment. FIG. 2 is a perspective view of a box 10 according to an embodiment.

Referring to FIG. 1 and FIG. 2, a box 10 according to an embodiment may include a first case 110 including a first opening 111 formed in at least one surface thereof and defining an interior 1101, a second case 120 that is insertable into the first case 110 through the first opening 111, a partition wall 130 that is disposable inside the first case 110, and a string or ribbon (hereinafter referred to as a "string") 140 that can be coupled to the partition wall 130. However, the configuration of the box 10 may not be limited thereto. For example, at least one element among the above-described elements may be omitted from the box 10, and the box 10 may further include at least one other element such as, for example, at least one of a third case 150 configured to accommodate the first case 110, at least one additional case 160 that is disposable inside the first case 110, or a retaining frame 170 that is disposable to retain the at least one additional case 160. For another example, the partition wall 130 may be formed integrally with the first case 110.

According to an embodiment, the box 10 may be configured to accommodate the above-described electronic device or accessory. For example, an electronic device or an accessory may be disposed inside at least one of the first case 110, the second case 120, or the at least one additional case 160.

According to an embodiment, the box 10 may be formed in a rectangular parallelepiped shape. For example, at least one of the first case 110, the second case 120, or the at least one additional case 160 may include a lower surface plate having a predetermined thickness and at least one side plate configured to surround the lower surface plate. The lower surface plate and the at least one side plate may be connected to each other so as to form a box shape having at least one open surface.

According to an embodiment, the first case 110 may further include at least one additional opening along with the first opening 111. At least one of the partition wall 130 or the at least one additional case 160 may be inserted into the first case 110 through the at least one additional opening.

According to an embodiment, the partition wall 130 may include an upper surface plate having a predetermined thickness and at least one side plate formed in a direction (e.g., the −z-axis direction) from at least one edge of the upper surface plate toward the lower surface plate of the first case 110. When the partition wall 130 is disposed inside the first case 110, the partition wall 130 may form a space inside the first case 110 by an upper surface plate and at least one side plate thereof. For example, the partition wall 130 may be configured to partition an interior 1101 of the first case 110 into an area into which the second case 120 is inserted and a remaining area.

According to an embodiment, the string 140 may be configured to function as a handle for withdrawing the second case 120 from the first case 110. One end of the string 140 may be coupled to the partition wall 130. At least a part of the string 140 may be disposed to surround at least a part of the second case 120 that is inserted inside the first case 110. The other end of the string 140 may be exposed to an outside the first case 110. When the other end of the string 140 is pulled by a user, the second case 120 may be withdrawn outside the first case 110 by the pulley principle.

According to an embodiment, the additional case 160 may include a first additional case 160*a*, a second additional case 160*b*, and a third additional case 160*c*. However, the configuration of the additional case 160 may not be limited thereto. For example, at least one additional case may be omitted from the additional case 160, and the additional case 160 may further include another additional case. The additional case 160 may be disposed inside the first case 110. For example, the additional case 160 may be disposed in the remaining area of the first case 110, which is formed by the partition wall 130.

According to an embodiment, the retaining frame 170 (see FIG. 2) may be disposed to retain the at least one additional case 160. For example, the retaining frame 170 may be configured to correspond to the edge of the at least one additional case 160. The retaining frame 170 may be disposed on the edge of the at least one additional case 160 so as to retain the at least one additional case 160. Therefore, when the box 10 is shaken or shocked, the retaining frame 170 may be configured to prevent the at least one additional case 160 from moving away from the first case 110 or from moving inside the first case 110.

According to an embodiment, the third case 150 may be configured to accommodate the first case 110 therein. The third case 150 may include a seating part 151 in which the first case 110 is disposed, and a cover 152 configured to extend from the seating part 151. The cover 152 may be formed to surround the first case 110. For example, the cover 152 may be configured to cover the at least one side plate and the upper surface of the first case 110. The third case 150 may be configured to function as an external case of the box 10. However, the configuration thereof may not be limited thereto.

According to an embodiment, the box 10 may include or be formed of paper or a paper product or plastic or a plastic product. At least one of the first case 110, the second case 120, the partition wall 130, the third case 150, or the at least one additional case 160 may include or be formed of paper or a paper product or plastic or a plastic product. For example, at least one of the first case 110, the second case 120, the partition wall 130, the third case 150, or the at least one additional case 160 may include at least one of corrugated cardboard or printed paper. However, the configuration thereof may not be limited thereto. For example, at least one of the first case 110, the second case 120, the partition wall 130, the third case 150, or the at least one additional case 160 may include coarse cardboard. In another embodiment, at least one of the first case 110, the second case 120, the partition wall 130, the third case 150, or the at least one additional case 160 may be formed of a plastic material.

Figure 3A:
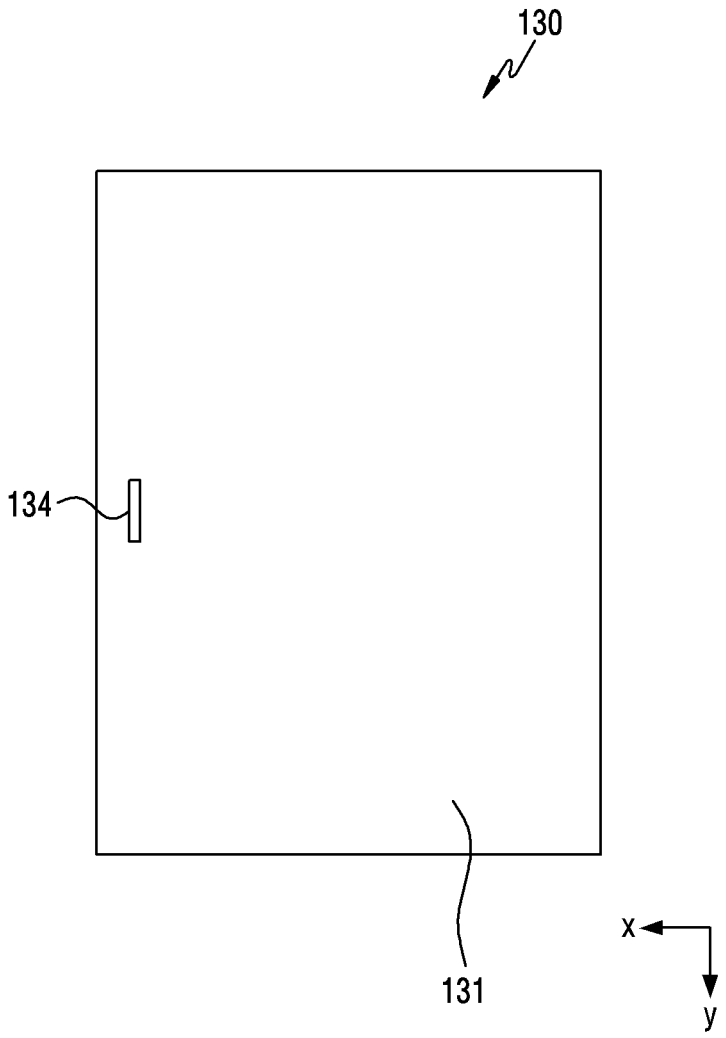
FIG. 3A and FIG. 3B are a plan view and a perspective view showing a partition wall according to an embodiment.
Figure 3B:
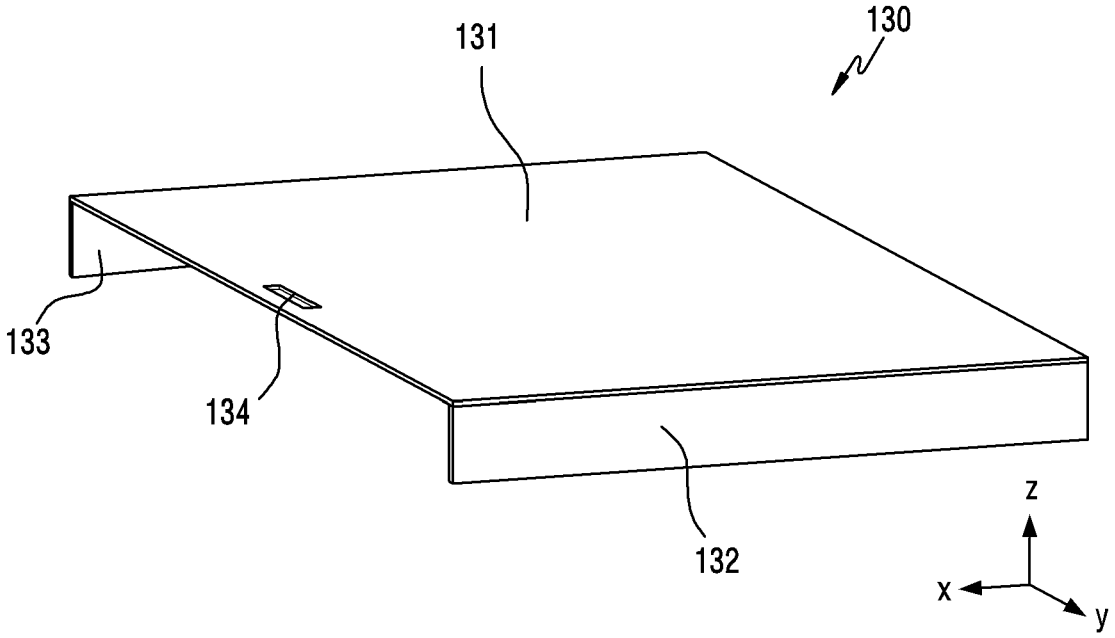

FIG. 3A and FIG. 3B are a plan view and a perspective view showing a partition wall 130 according to an embodiment.

A partition wall 130 of FIG. 3A and FIG. 3B may be referred to by the partition wall 130 of FIG. 1 and FIG. 2. The same reference numerals may be used for the same or substantially the same elements as elements described above, and overlapping descriptions will be omitted.

Referring to FIG. 3A and FIG. 3B, the partition wall 130 may include an upper surface plate 131, a first side plate 132 formed to extend from one edge of the upper surface plate 131, and a second side plate 133 configured to face the first side plate 132.

According to an embodiment, the partition wall 130 may include at least one accommodation structure. For example, the partition wall 130 may include at least one second opening 134. The second opening 134 may be formed in the upper surface plate 131 of the partition wall 130.

According to an embodiment, the second opening 134 may be spaced apart from the edge of the upper surface plate 131 while having a predetermined separation distance. For example, when the partition wall 130 is disposed inside the first case (110 of FIG. 1), the second opening 134 may be formed at a position closer to one surface, in which the first opening (111 of FIG. 1) of the first case 110 is formed, than a surface opposite to the one surface in which the first opening 111 is formed.

Figure 4:
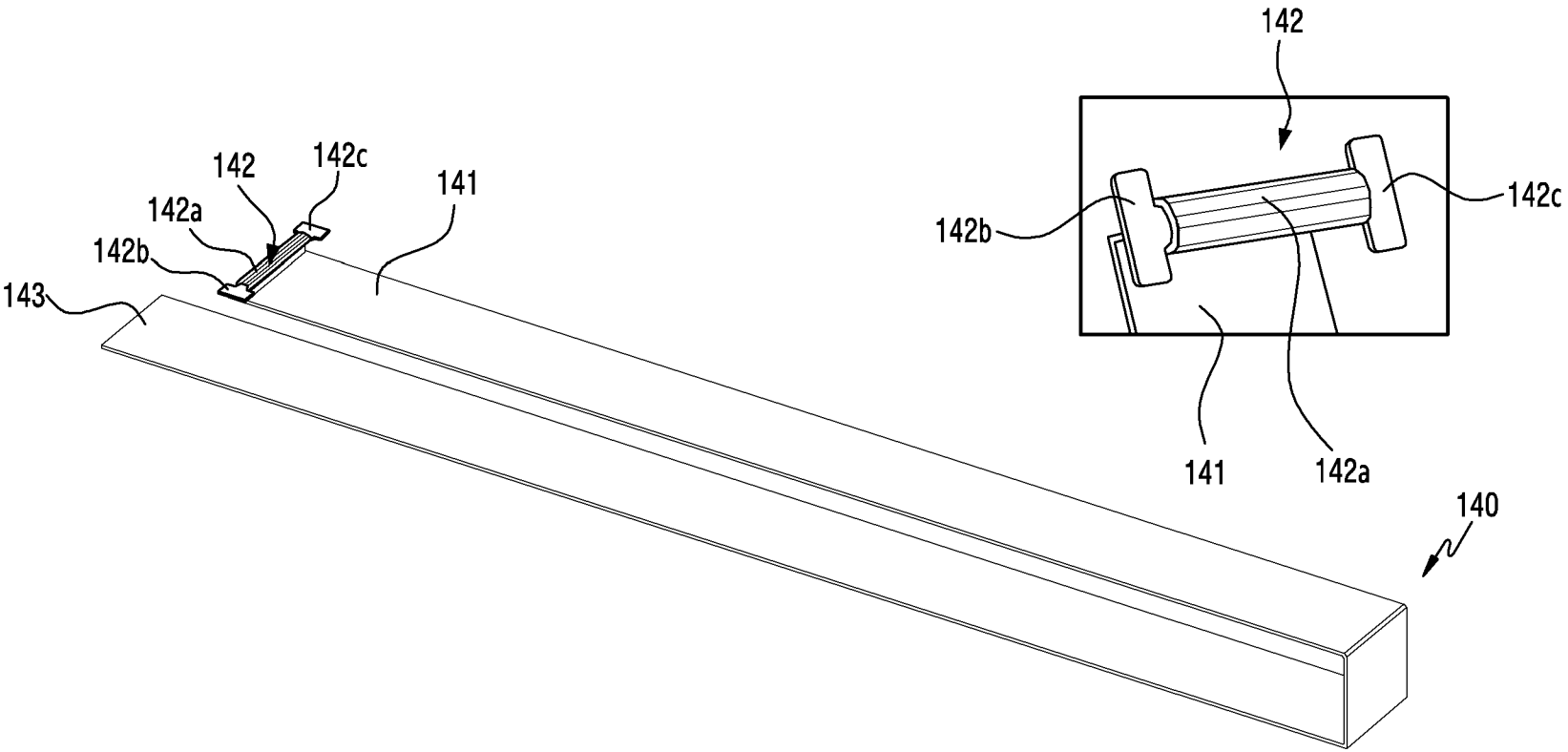
FIG. 4 is a perspective view showing a string according to an embodiment.

FIG. 4 is a perspective view showing a string 140 according to an embodiment.

A string 140 may be referred to by the string 140 of FIG. 1. Overlapping descriptions for the same or substantially the same elements as elements described above will be omitted.

Referring to FIG. 4, the string 140 may include at least one engaging structure 142 disposed at one end 141 thereof. The one end 141 of the string may be coupled to the partition wall by the engaging structure 142. For example, the one end 141 of the string may be strung through the second opening (134 of FIG. 3A and FIG. 3B) and thus may be coupled to the partition wall 130.

According to an embodiment, the string 140 may have a width which is less than a width of the second opening 134 and the at least one engaging structure 142 may have a width greater than the width of the second opening 134 and greater than the width of the string 140. Accordingly, the string 140 can pass through the second opening 134 (see the second opening 134 of FIG. 3A and FIG. 3B), and the at least one engaging structure 142 cannot pass through the second opening 134. Accordingly, the string 140 may be coupled to the partition wall 130 (see the partition wall 130 of FIG. 3A and FIG. 3B) by the engaging structure 142.

According to an embodiment, the at least one engaging structure 142 may include an engaging member. The engaging member may include a body part 142*a* disposed at the one end 141 of the string 140, a first engaging part 142*b* configured to extend from one end of the body part 142*a*, and a second engaging part 142*c* configured to extend from the other end of the body part 142*a*. The engaging member may be configured such that the string 140 is caught (or coupled) to the partition wall 130 by the first engaging part 142*b* and the second engaging part 142*c* so that the string 140 is retained thereto.

According to an embodiment, the first engaging part 142*b* and the second engaging part 142*c* may be configured to protrude so as to face directions (e.g., the y-axis direction of FIG. 3A and FIG. 3B) different from the longitudinal direction (e.g., the x-axis direction of FIG. 3A and FIG. 3B) of the string 140. For example, the first engaging part 142*b* and the second engaging part 142*c* may be configured to protrude in a direction substantially perpendicular to the longitudinal direction (e.g., the x-axis direction of FIG. 3A and FIG. 3B) of the string 140. However, the configuration thereof may not be limited thereto. For example, the first engaging part 142*b* and the second engaging part 142*c* may be configured to protrude so as to face a direction different from the direction in which the string 140 is pulled by a user.

According to an embodiment, the width of at least a part of the first engaging part 142*b* and the width of at least a part of the second engaging part 142*c* may be greater than the width of at least a part of the body part 142*a*. According to an embodiment, the first engaging part 142*b* may be formed to be symmetrical with the second engaging part 142*c* with reference to the body part 142*a*. However, the configuration thereof may not be limited thereto.

According to an embodiment, the at least one engaging structure 142 (e.g., the engaging member) may be formed of a rigid material (for example, a polymer material or a metal material). However, the configuration thereof may not be limited thereto. For example, the at least one engaging structure 142 may be formed of a rubber or silicone material.

According to an embodiment, the string 140 may include at least partial area having a flat surface. However, the configuration thereof may not be limited thereto.

Figure 5A:
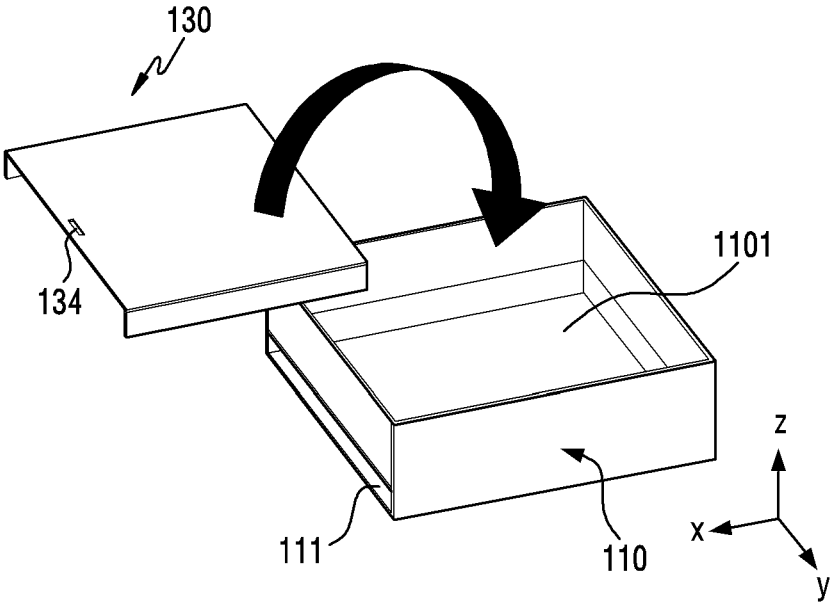
FIG. 5A and FIG. 5B are perspective views showing a process of disposing a partition wall in a first case according to an embodiment.
Figure 5B:
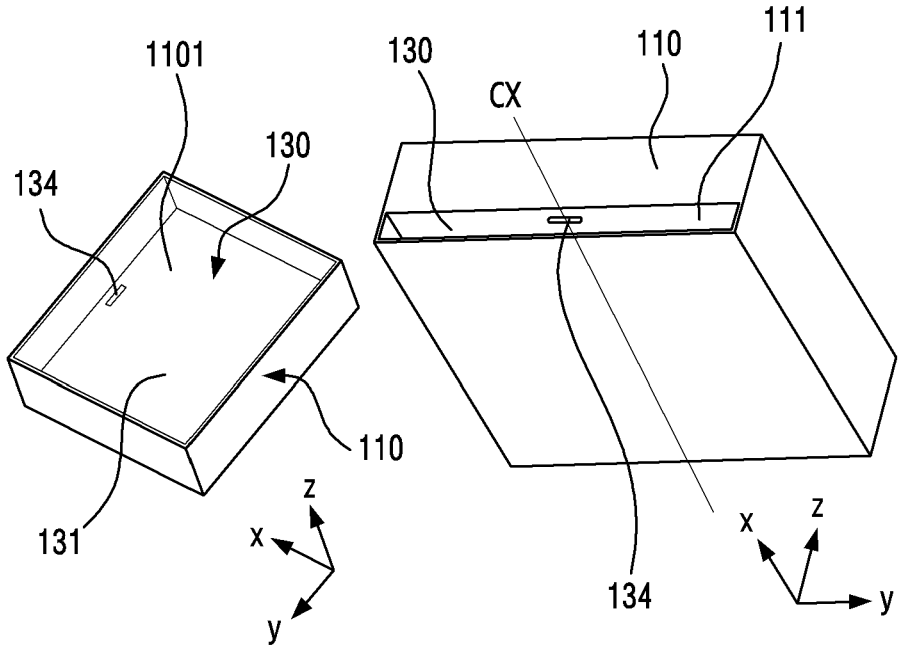
Figure 6:
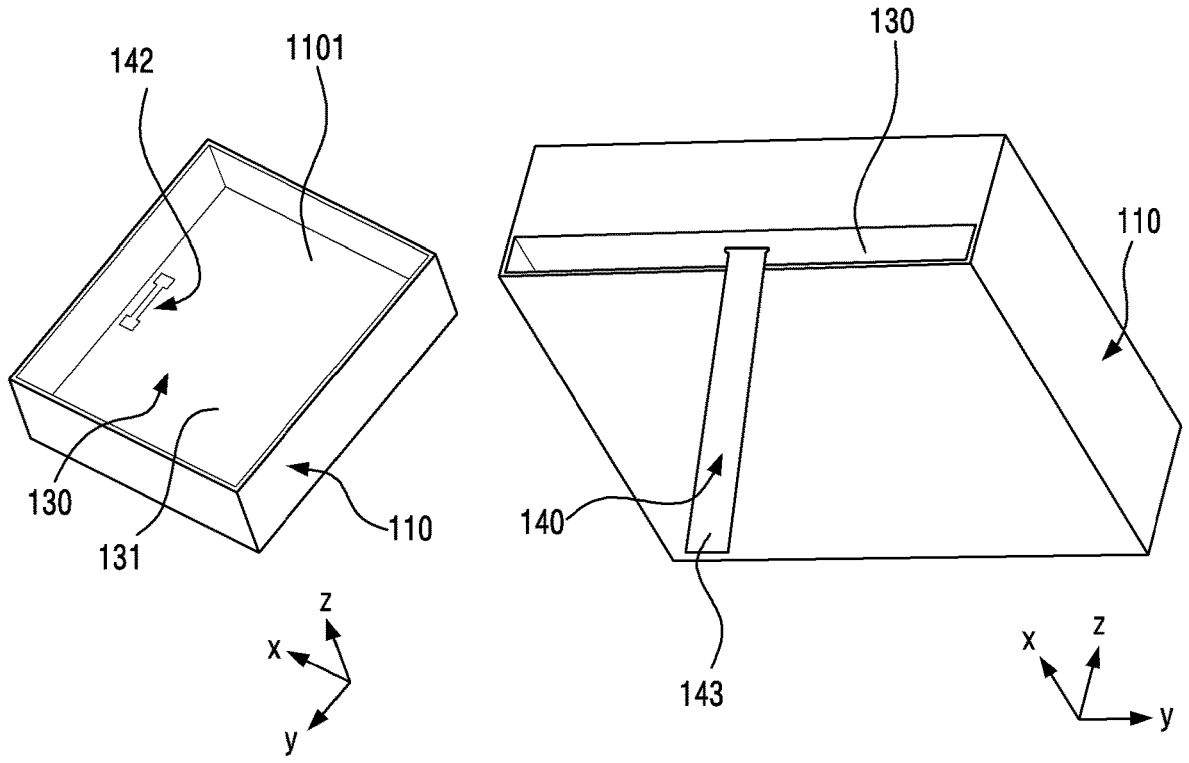
FIG. 6 is a perspective view showing a process of coupling a string to a partition wall according to an embodiment.
Figure 7A:
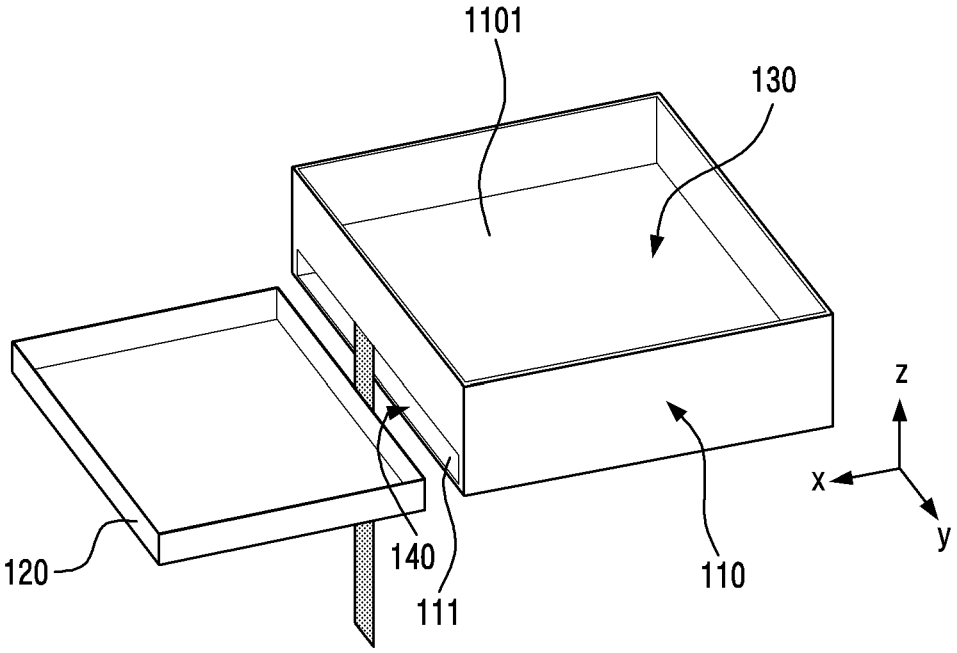
FIG. 7A and FIG. 7B are perspective views showing a process of inserting a second case into a first case according to an embodiment.
Figure 7B:
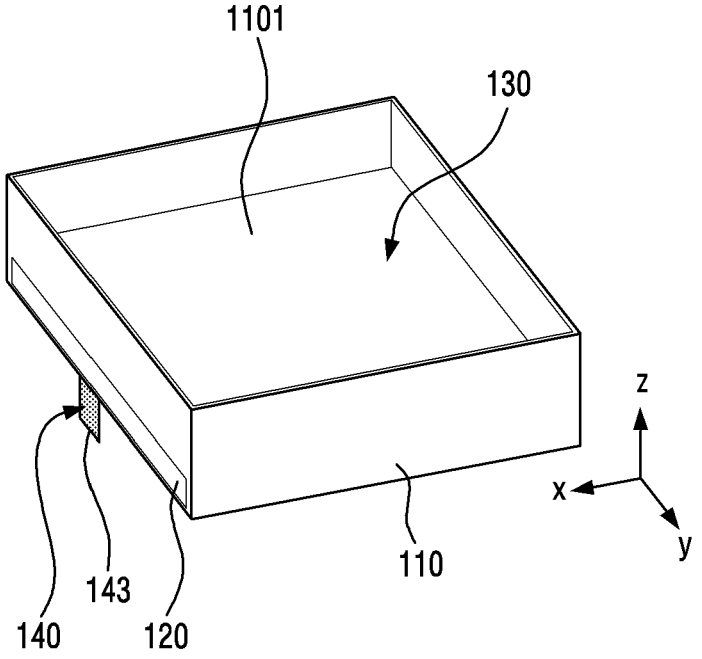

FIG. 5A and FIG. 5B are perspective views showing a process of disposing a partition wall 130 in a first case 110 according to an embodiment. FIG. 6 is a perspective view showing a process of coupling a string 140 to a partition wall 130 according to an embodiment. FIG. 7A and FIG. 7B are perspective views showing a process of inserting a second case 120 into a first case 110 according to an embodiment.

A first case 110, a second case 120, a partition wall 130, and a string 140 may be referred to by the first case 110, the second case 120, the partition wall 130, and the string 140 of FIG. 1 to FIG. 4. The same reference numerals may be used for the same or substantially the same elements as elements described above, and overlapping descriptions will be omitted.

According to an embodiment, an assembly process of the box 10 may include a process of disposing the partition wall 130 in the interior 1101 of the first case 110, a process of coupling the string 140 to the partition wall 130, and a process of inserting the second case 120 into the first case 110. However, the assembly process of the box 10 may not be limited thereto. For example, the assembly process of the box 10 may further include a process of disposing at least one additional case (160 of FIG. 1) in the interior 1101 of the first case 110, a process of disposing the retaining frame 170 on an upper part of the at least one additional case 160, or a process of packaging the first case 110 by using the third case 150.

Referring to FIG. 5A, in the process of disposing the partition wall 130 in the interior 1101 of the first case 110, the partition wall 130 may be disposed inside the first case 110 through the first opening 111 of the first case 110. The side plate of the partition wall 130 may face the inner bottom surface of the first case 110, and the upper surface plate of the partition wall 130 may be spaced apart from the inner bottom surface of the first case 110. Accordingly, the partition wall 130 may partition the interior 1101 of the first case 110.

Referring to FIG. 5B, according to an embodiment, the second opening 134 of the partition wall 130 may be adjacent to the first opening 111 of the first case 110. For example, the second opening 134 may be disposed at a position closer to one side of the first case 110, in which the first opening 111 is formed, than a surface opposite to the one surface of the first case 110, in which the first opening 111 is formed.

According to an embodiment, the second opening 134 may be formed at the central axis CX (see FIG. 5B) of the upper surface plate 131 of the partition wall 130. For example, the second opening 134 may be formed at the center of the width (e.g., the width of the partition wall 130 in the y-axis direction) of the partition wall 130. Alternatively, the second opening 134 may be disposed in an area corresponding to the central axis CX of the first opening 111. For example, the second opening 134 may be formed at the center of the width (e.g., the width of the first opening 111 in the y-axis direction) of the first opening 111. The reference numeral CX illustrated in FIG. 5B may indicate the central axis of the partition wall 130 or the central axis of the first opening 111.

Referring to FIG. 6, in the process of coupling the string 140 to the partition wall 130, the string 140 may be coupled to the partition wall 130 through the second opening 134. According to an embodiment, the process of coupling the string 140 to the partition wall 130 through the second opening 134 may include a process of disposing at least one engaging structure 142 disposed at one end of the string 140 to be caught on the partition wall 130.

According to an embodiment, in the process of disposing the engaging structure 142 to be caught on the partition wall 130, the one end of the string 140 may be coupled to the partition wall 130 by the at least one engaging structure 142 through the second opening 134. For example, the second opening 134 may be formed to have a size which allows the string 140 to pass therethrough and does not allow the engaging structure 142 to pass therethrough, and thus at least one engaging structure 142 may be coupled to the partition wall 130 through the second opening 134.

According to an embodiment, the width of the at least one engaging structure 142 in the longitudinal direction (e.g., the y-axis direction) may be greater than the width of the at least one second opening 134. Since the width of the at least one engaging structure 142 in the longitudinal direction is greater than the width of the at least one second opening 134 in the longitudinal direction, the at least one engaging structure 142 may be coupled to the partition wall 130 through the second opening 134. Since the at least one engaging structure 142 is coupled to the partition wall 130 through the second opening 134, the string 140 may be effectively fixed to the partition wall 130. Accordingly, when a user performs an operation of pulling the other end of the string 140, the at least one engaging structure 142 may prevent the string 140 from being pulled through the second opening 134 and then separated from the partition wall 130.

Referring to FIG. 7A, in the process of inserting the second case 120 into the interior 1101 of the first case 110, the second case 120 may be inserted into the first case 110 through the first opening 111 of the first case 110. According to an embodiment, as the second case 120 is inserted into the first case 110, a part of the string 140, which is coupled to the partition wall 130, may be inserted into the inside of the first case 110. Accordingly, a part of the string 140 may be disposed to surround at least a part of the second case 120. For example, a part of the string 140 may be disposed between the inner bottom surface of the first case 110 and the second case 120. As the second case 120 is inserted into the first case 110, a part of a remainder thereof of the string 140 may be exposed at the outside of the first case 110.

Referring to FIG. 7B, when the second case 120 is inserted inside the interior 1101 of the first case 110, one end 143 of the string 140 may be exposed at the outside of the first case 110. The one end 143 of the string 140 may be exposed outside the first case 110 through a space between the inner bottom surface of the first case 110 and the second case 120. When the one end 143 of the string 140, which is exposed to the outside, is pulled by a user, at least a part of the second case 120 may be withdrawn by a pulling action from the first case 110.

According to an embodiment, when a user performs an operation of pulling the one end 143 of the string 140, an area of the string 140, which is to be exposed at the outside of the first case 110, may increase as the second case 120 is withdrawn to the outside of the first case 110. For example, as the second case 120 is withdrawn to the outside of the first case 110, the length of the area of the string 140, which is to be exposed outside the first case 110, may increase.

Figure 8:
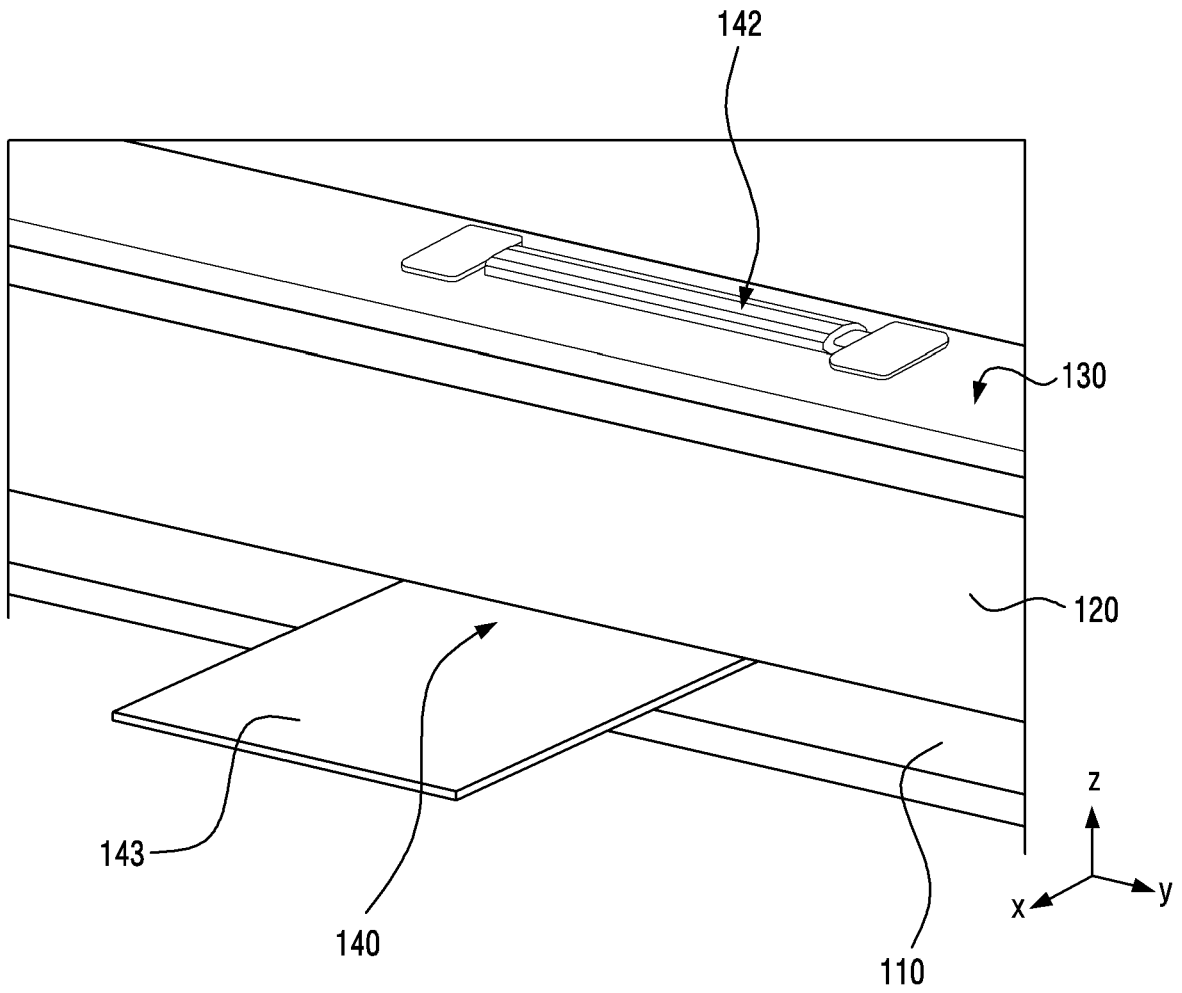
FIG. 8 is a perspective view showing a first case in which a partition wall, to which a string is coupled, is disposed according to an embodiment.
Figure 9A:
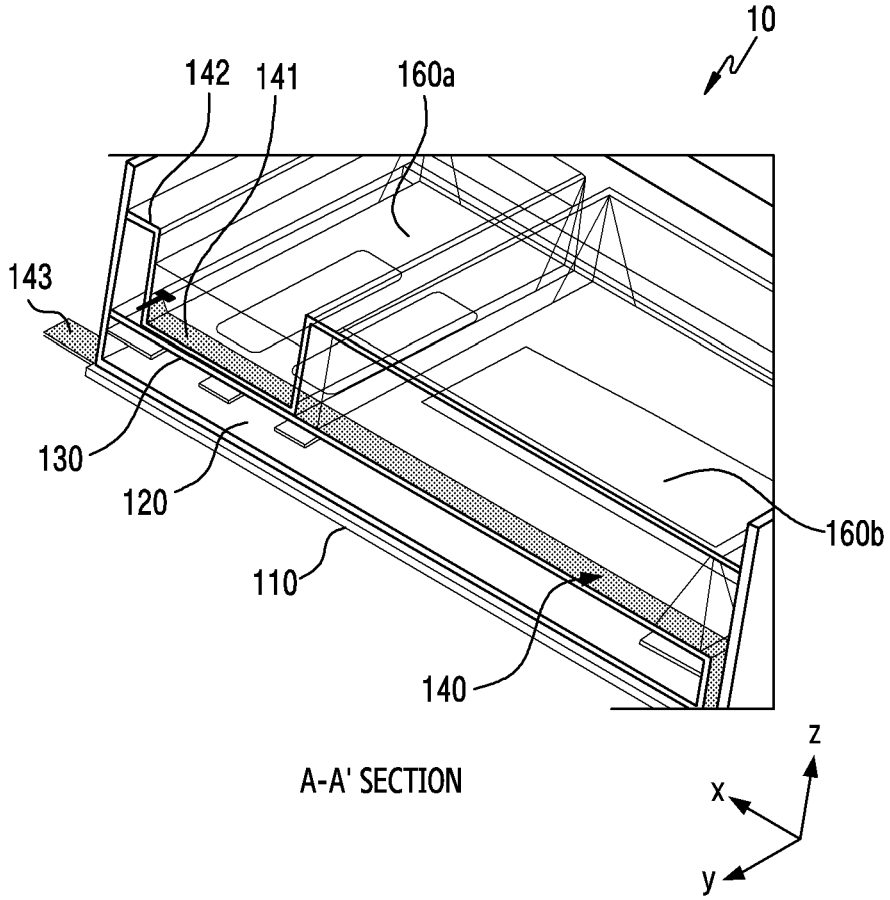
FIG. 9A and FIG. 9B are a perspective view and a cross-sectional view of a box according to an embodiment.
Figure 9B:
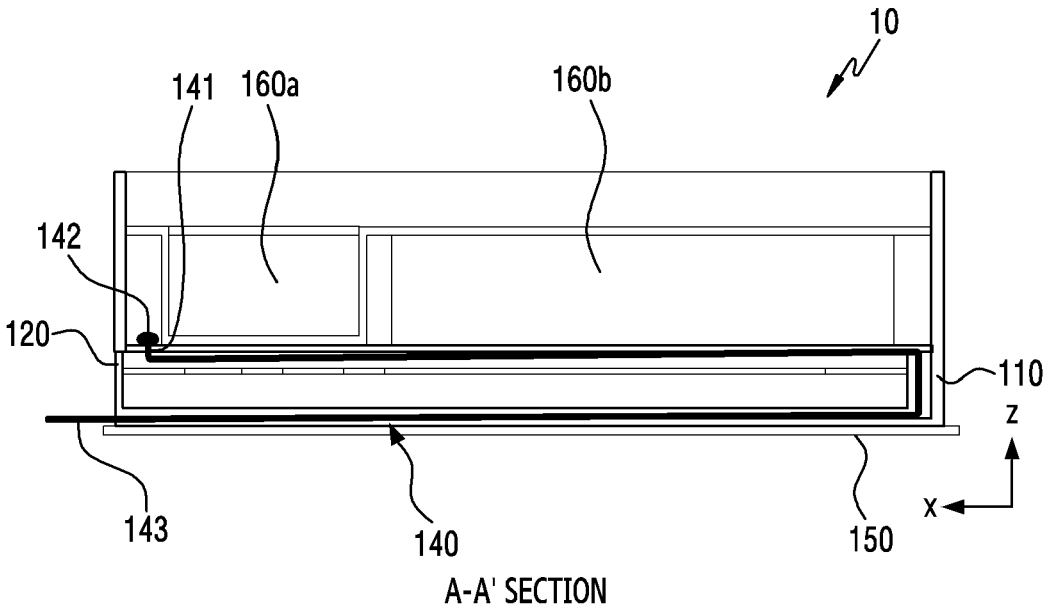

FIG. 8 is a perspective view showing a first case 110 in which a partition wall 130, to which a string 140 is coupled, is disposed according to an embodiment. FIG. 9A and FIG. 9B are a perspective view and a cross-sectional view of a box 110 according to an embodiment. FIG. 9A and FIG. 9B may be cross-sectional views showing a cross-section taken along the line A-A' of FIG. 2 (A-A' SECTION).

A first case 110, a second case 120, a partition wall 130, and a string 140 may be referred to by the first case 110, the second case 120, the partition wall 130, and the string 140 of FIG. 1 to FIG. 7B. The same reference numerals may be used for the same or substantially the same elements as elements described above, and overlapping descriptions will be omitted.

Referring to FIG. 8, FIG. 9A and FIG. 9B, one end of the string 140 may be fixed to the partition wall 130 by an engaging structure 142. The other end 143 of the string 140 may be exposed at the outside of the first case 110. Since a user pulls the other one end 143 of the string 140, the second case 120 may be withdrawn with a little force from the first case 110. Accordingly, when a user performs an operation of pulling the string 140, the string 140 may not be separated from the partition wall 130.

Referring to FIG. 9A and FIG. 9B, at least a part of the string 140 may be disposed to surround at least a part of the second case 120. When a user performs an operation of pulling the string 140, at least a part of the string 140 may move while being in contact with the outer wall of the second case 120. Accordingly, when a user performs an operation of pulling the string 140, the second case 120 may be withdrawn to the outside of the first case 110 by the principle of a movable pulley. In addition, when a user performs an operation of pulling the string 140, the user may feel a vibration due to friction between the string 140 and the second case 120. Therefore, when a user performs an operation of pulling the string 140, a tactile, auditory, or visual satisfaction of a user may be improved due to the vibration.

Figure 10:
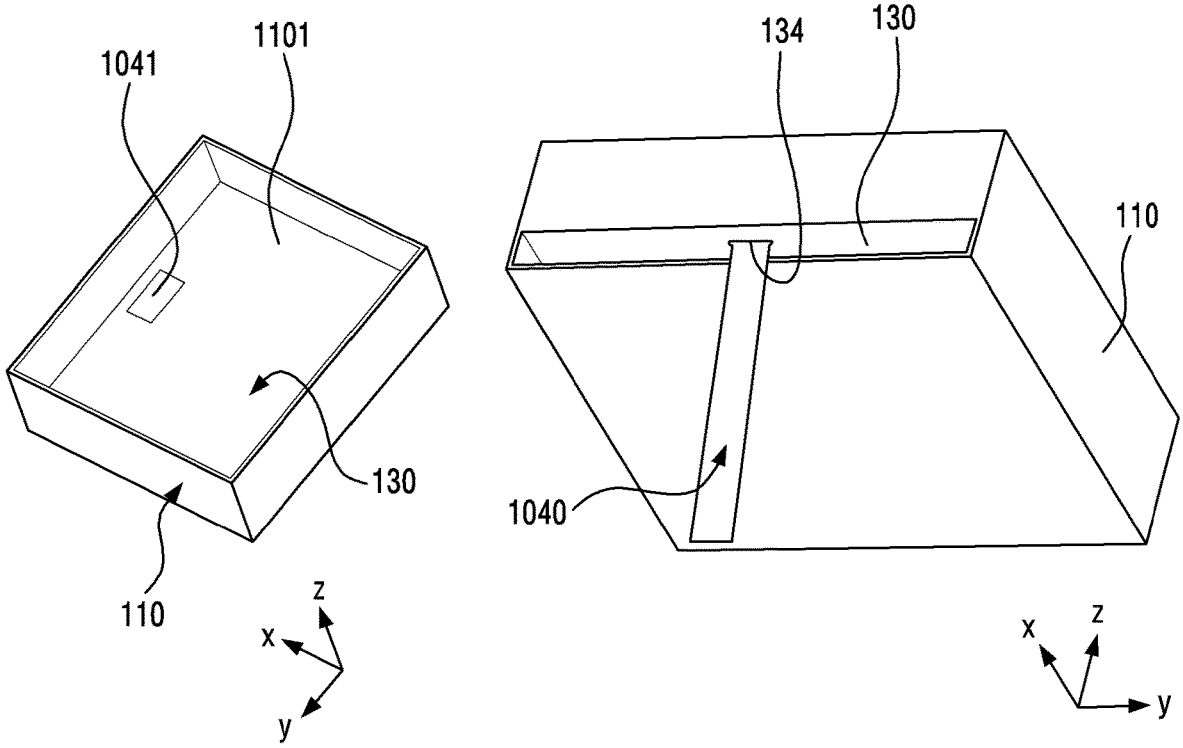
FIG. 10 is a perspective view showing a first case in which a partition wall, to which a string is coupled, is disposed according to another embodiment.

FIG. 10 is a perspective view showing a first case 110 in which a partition wall 130, to which a string 1040 is coupled, is disposed according to another embodiment.

A first case 110, a partition wall 130, and a string 1040 may be referred to by the first case 110, the partition wall 130, and the string 140 of FIG. 1 to FIG. 9B. Overlapping descriptions for the same or substantially the same elements as elements described above will be omitted.

According to an embodiment, the string 1040 may be coupled to the partition wall 130 by using an adhesive 1041. For example, one end of the string 1040 may be coupled to the partition wall 130 by using at least one of a tape or a bond or another suitable adhesive. However, the coupling method may not be limited thereto. For example, the string 1040 may be coupled to the partition wall 130 through at least one process of a fusion process or a structural coupling process.

According to an embodiment, the string 1040 may be coupled to the partition wall 130 by using at least one of a tape or a bond or another suitable adhesive in a state of being inserted into the second opening 134 of the partition wall 130. However, the configuration thereof may not be limited thereto. For example, the string 1040 may be coupled to the partition wall 130 by using an adhesive 1041 on the rear surface of the partition wall 130.

Figure 11A:
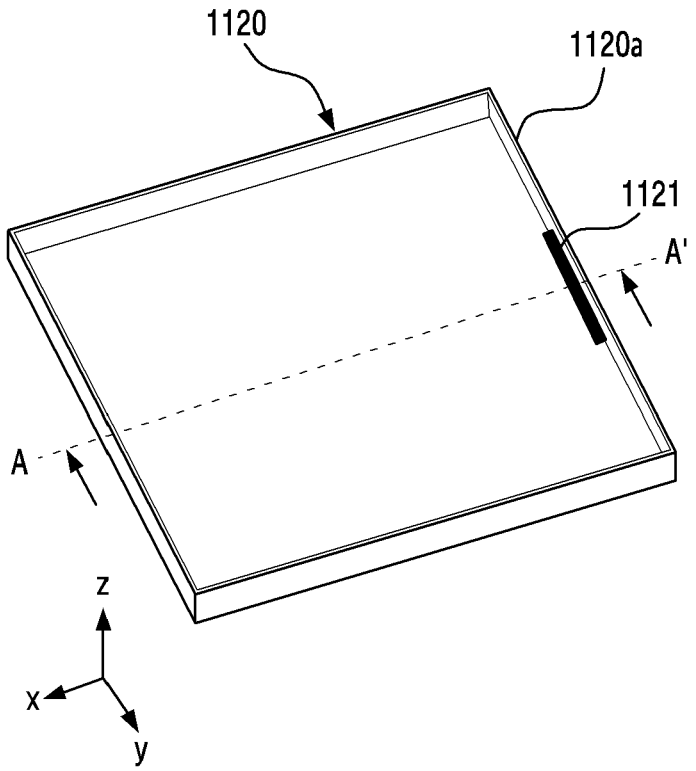
FIG. 11A and FIG. 11B are a perspective view and a cross-sectional view showing a second case according to an embodiment.
Figure 11B:
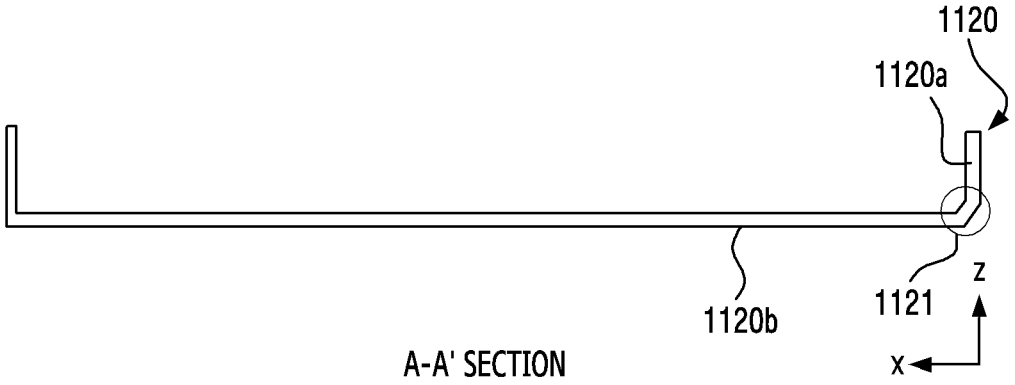

FIG. 11A and FIG. 11B are a perspective view and a cross-sectional view showing a second case 1120 according to an embodiment.

A second case 1120 may be referred to by the second case 120 of FIG. 1 to FIG. 9B. Overlapping descriptions for the same or substantially the same elements as elements described above will be omitted.

Referring to FIG. 11A and FIG. 11B, the second case 1120 may include a lower surface plate 1120*b* having a predetermined thickness, and at least one side plate configured to surround the lower surface plate 1120*b*. In a state in which the second case 1120 is inserted into the first case (e.g., the first case 110 of FIG. 1), the at least one side plate may include a side plate 1120*a* facing a side plate of the second case 1120, which is disposed in the first opening (e.g., the first opening 111 of FIG. 1) of the first case. According to an embodiment, the side plate 1120*a* may mean a surface of the second case, with which the string (e.g., the string 140 of FIG. 2) is in contact with the string when the string moves by a user pulling a part of the string, which is exposed to the outside, in a state in which the second case 1120 is inserted into the first case. Although FIG. 11A and FIG. 11B illustrate an embodiment in which a chamfer shape 1121 is provided in only one edge thereof, multiple chamfer shapes may be formed. For example, a chamfer shape may also be provided on the upper end of the second case 1120.

According to an embodiment, the second case 1120 may be configured such that at least a part of at least one edge thereof includes the chamfer shape 1121. For example, at least a part of edges between the side plate 1120*a* and the lower surface plate 1120*b* of the second case 1120 may include the chamfer shape 1121. The chamfer shape 1121 may mean a shape in which the edge of an angled end surface is cut or otherwise angled.

According to an embodiment, the second case 1120 may be configured such that at least a part of at least one edge thereof includes the chamfer shape 1121, and thus the usability of the box by a user may be improved. For example, when a user performs an operation of pulling the string in order to withdraw the second case 1120, the chamfer shape 1121 may contribute to improving movability of the string.

Figure 12A:
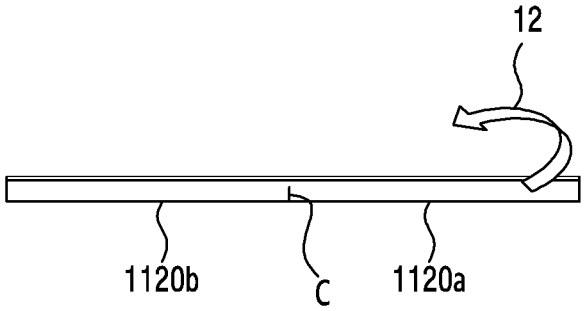
FIG. 12A, FIG. 12B, and FIG. 12C are cross-sectional views showing a manufacturing process of the second case of FIG. 11A and FIG. 11B.
Figure 12B:
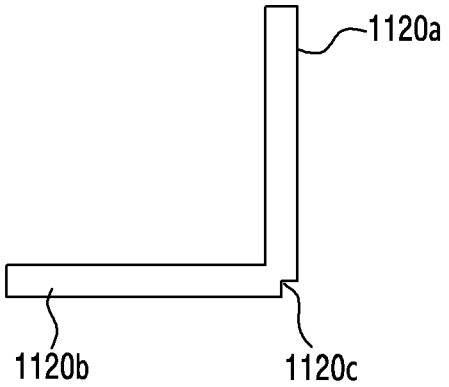
Figure 12C:
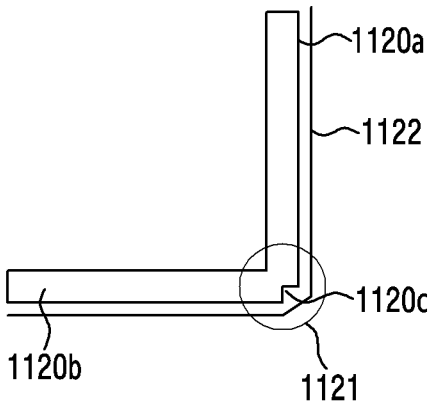

FIG. 12A, FIG. 12B, and FIG. 12C are cross-sectional views showing a manufacturing process of the second case 1120 of FIG. 11A and FIG. 11B.

A second case 1120 may be referred to by the second case 1120 of FIG. 11A and FIG. 11B. The same reference numerals may be used for the same or substantially the same elements as elements described above, and overlapping descriptions will be omitted.

Referring to FIG. 12A, FIG. 12B, and FIG. 12C, a manufacturing process of the second case 1120 according to an embodiment may include a process (FIG. 12A) of cutting at least a part of the thickness of at least one surface of the second case 1120, a process (FIG. 12B) of folding at least one surface of the second case 1120 with reference to the cut area C, and a process (FIG. 12C) of placing at least one coating material 1122 on at least a part of the cut area. However, the manufacturing process of the second case 1120 may be not limited thereto. For example, at least one process described above may be omitted from the manufacturing process of the second case 1120, and the manufacturing process of the second case 1120 may further include another additional process. For example, the manufacturing process of the second case 1120 may further include a process of disposing at least one retaining structure on at least one surface of the second case 1120.

Referring to FIG. 12A, in the process of cutting at least a part of the thickness of at least one surface of the second case 1120, at least a part of at least one surface of the second case 1120 may be configured such that at least a part of the thickness of the one surface thereof is cut. For example, the second case 1120 may be configured such that at least a part of the thickness between the lower surface plate 1120*b* and the side plate 1120*a* of the second case 1120 is cut. According to an embodiment, in the process, the second case 1120 may have at least one surface subject to half-cutting. However, the configuration thereof may not be limited thereto. The reference numeral C illustrated in FIG. 12A may indicate an area in which, among the second case 1120, at least a part of the thickness is cut.

According to an embodiment, at least one surface of the second case 1120 may be folded with reference to the cut area C. For example, at least one surface of the second case 1120 may be folded such that the cut area C faces the outside of the second case 1120. For example, a first direction 12 of FIG. 12A may indicate a direction in which one surface of the second case 1120 is folded.

According to an embodiment, in the process of folding at least one surface of the second case 1120 with reference to the cut area C, the second case 1120 may have an edge formed by the at least one surface of the second case 1120 that is folded. Referring to FIG. 12B, the portion between the lower surface plate 1120*b* and the side plate 1120*a* may be folded with reference to the cut area C. As the portion between the lower surface plate 1120*b* and the side plate 1120*a* is folded, a groove 1120*c*, which is concavely formed toward the inside of the second case 1120, may be formed in the cut area C (or the edge of the second case 1120).

According to an embodiment, the second case 1120 may include the at least one coating material 1122 disposed on at least a part of the second case 1120. Referring to FIG. 12C, the at least one coating material 1122 may be disposed to surround at least a part of an outer surface of the second case 1120. For example, the at least one coating material 1122 may be configured to cover the edge of the second case 1120. The at least one coating material 1122 may be configured to cover the groove 1120*c* of the second case 1120. Since the at least one coating material 1122 is disposed to cover the groove 1120*c*, the chamfer shape 1121 may be formed on at least one edge of the second case 1120.

According to an embodiment, the at least one coating material 1122 may include paper or a paper product or another suitable material. For example, the at least one coating material 1122 may include at least one of coarse cardboard or printed paper. However, the configuration thereof may not be limited thereto. For example, the at least one coating material 1122 may include a material capable of improving movability of the string.

According to an embodiment, the second case 1120 may be configured such that at least a part of at least one edge thereof includes the chamfer shape 1121, and thus the usability of the box by a user may be improved. For example, when a user performs an operation of pulling the string in order to withdraw the second case 1120, the chamfer shape 1121 may contribute to improving movability of the string.

Figure 13A:
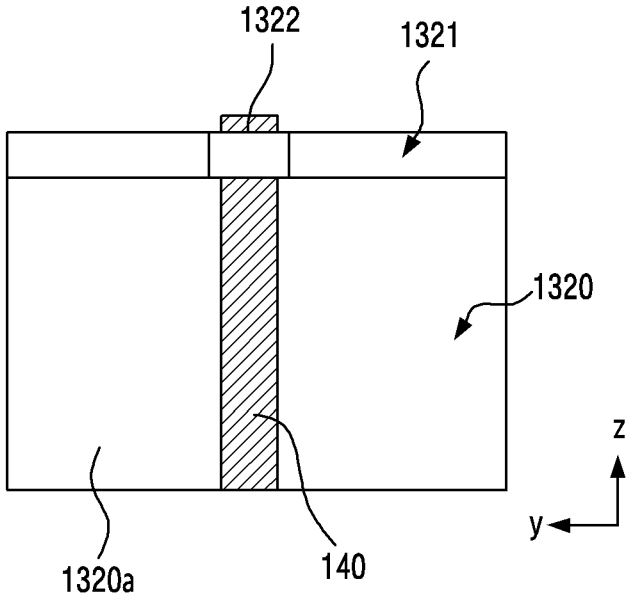
FIG. 13A and FIG. 13B are plan views showing a second case including a retaining structure according to an embodiment.
Figure 13B:
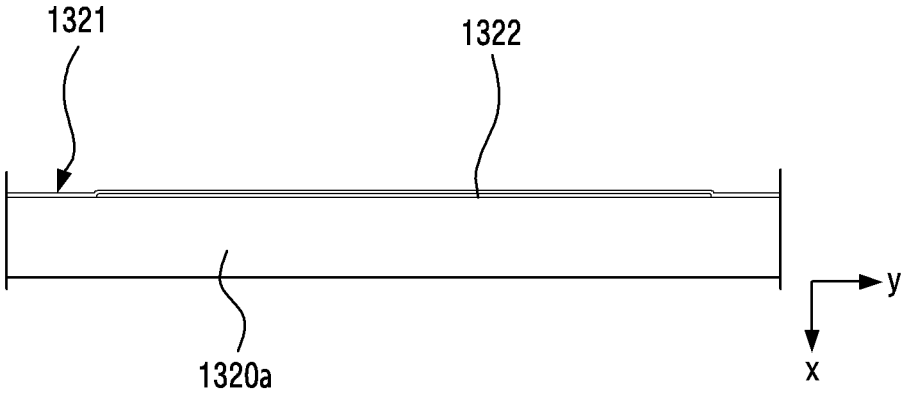

FIG. 13A and FIG. 13B are plan views showing a second case 1320 including a retaining structure 1321 according to an embodiment.

A second case 1320 may be referred to by the second case 120 of FIG. 1 to FIG. 9B and the second case 1120 of FIG. 11A to FIG. 12C. Overlapping descriptions for the same or substantially the same elements as elements described above will be omitted.

Referring to FIG. 13A and FIG. 13B, the second case 1320 may include at least one retaining structure 1321 that is disposed on at least one surface of the second case 1320. The at least one retaining structure 1321 may be disposed in a path which is in contact with the second case 1320 when the string 140 moves by pulling a part of the string 140, which is exposed to the outside, in a state in which the second case 1320 is inserted into a first case (e.g., the first case 110 of FIG. 2). For example, at least one retaining structure 1321 may be disposed on a side plate 1320*a* of the second case 1320. However, the configuration thereof may not be limited thereto. For example, the at least one retaining structure 1321 may be also disposed on the rear surface of the lower surface plate (e.g., the lower surface plate 1120*b* of FIG. 11A and FIG. 11B) of the second case 1320. The side plate 1320*a* of the second case 1320 may be referred to by the side plate 1220*a* of the FIG. 11A and FIG. 11B.

According to an embodiment, the at least one retaining structure 1321 may include at least one opening 1322 through which the string 140 passes. The at least one opening 1322 may have a width substantially the same as the width of the string 140. However, the configuration thereof may not be limited thereto. The at least one retaining structure 1321 may be configured to prevent the string 140 from being shaken in the left or right (e.g., the y-axis direction) when the string 140, which has passed through the at least one opening 1322, moves by being pulled by a user. Accordingly, when a user performs an operation of withdrawing the second case 1320 to the outside of the first case by pulling the string 140, the usability of the box by a user may be improved.

According to an embodiment, the at least one opening 1322 may be a hole formed by the retaining structure 1321 that is spaced apart from at least one surface of the second case 1320 while having a predetermined separation distance. However, the configuration thereof may not be limited thereto.

According to an embodiment, the at least one retaining structure 1321 may be disposed at a central axis of the second case 1320. For example, the at least one opening 1322 of the at least one retaining structure 1321 may be disposed at the central axis of the second case 1320. Accordingly, when a user pulls a part of the string 140 in a state in which the second case 1320 is inserted into the first case, the string 140 may move along the central axis of the second case 1320.

Figure 14A:
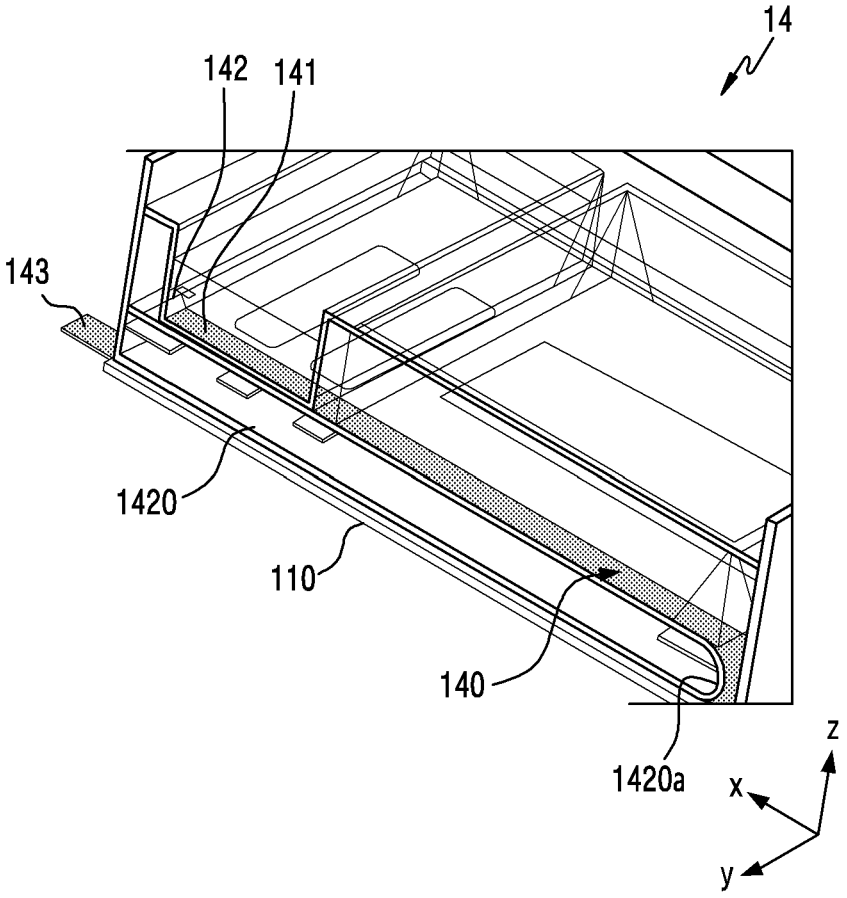
FIG. 14A and FIG. 14B are a perspective view and a cross-sectional view of a box including a second case according to another embodiment.
Figure 14B:
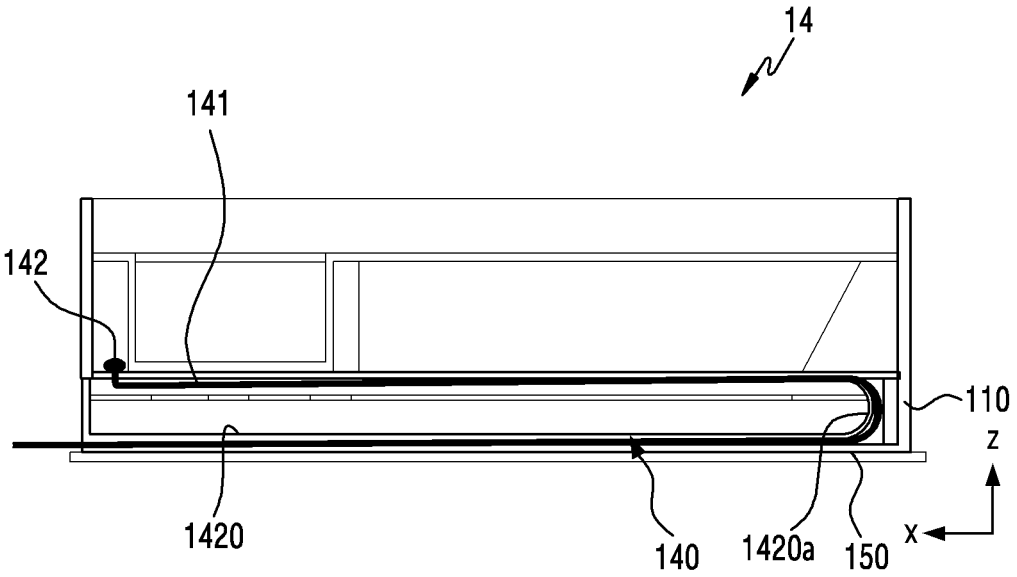

FIG. 14A and FIG. 14B are a perspective view and a cross-sectional view of a box 14 including a second case 1420 according to another embodiment.

A box 14 may be referred to by the box 10 of FIG. 1. Elements (e.g., the first case 110 and the string 140) of the box 14 may be referred to by the elements of the box 10 of FIG. 1 to FIG. 13B. The same reference numerals may be used for the same or substantially the same elements as elements described above, and overlapping descriptions will be omitted.

According to an embodiment, at least one surface of the second case 1420 may include a curved surface that is convexly formed. The at least one surface of the second case 1420 may mean at least one surface of the second case 1420, which is in contact with the string 140 when the string 140 moves by pulling one end 143 of the string 140, which is exposed to the outside, in a state in which the second case 1420 is inserted into the first case 110. For example, referring to FIG. 14A and FIG. 14B, a side plate 1420*a* of the second case 1420 may include a curved surface.

According to an embodiment, at least one surface of the second case 1420 may include a curved surface. Therefore, when a user performs an operation of pulling the string 140 in order to withdraw the second case 1420 from the first case 110, the curved surface of the second case 1420 may contribute to improving the mobility of the string 140. Accordingly, the usability of the box 14 by a user may be improved.

As described above, a box (e.g., the box 10 FIG. 1) according to an embodiment may include a first case including a first opening formed in at least one surface thereof, a second case inserted into the first case through the first opening, a partition wall configured to partition an interior of the first case into an area into which the second case is inserted and a remaining area, and a string which has one end coupled to the partition wall and which is configured such that when the second case is inserted into the first case, a part thereof is inserted into the first case and a part of a remainder thereof is exposed at an outside of the first case, wherein at least a part of the second case is withdrawn from the first case by the part of the remainder thereof being pulled in a state in which the second case is inserted in the first case.

According to an embodiment, the string may include at least one engaging structure disposed at the one end of the string, and the engaging structure is configured to be caught on the partition wall so that the string is coupled to the partition wall by the engaging structure.

According to an embodiment, the partition wall may include at least one second opening formed in one surface thereof, the at least one second opening being formed in a size configured to allow the string to pass therethrough and not to allow the engaging structure to pass therethrough.

According to an embodiment, the engaging structure may have a lengthwise width greater than the lengthwise width of the at least one second opening.

According to an embodiment, the at least one second opening may be formed at a position closer to a surface, in which the first opening is formed, than a surface opposite to the surface in which the first opening of the first case is formed.

According to an embodiment, the at least one engaging structure may include an engaging member including a body part disposed at the one end of the string, a first engaging part configured to extend from one end of the body part, and a second engaging part configured to extend from the other end of the body part.

According to an embodiment, the engaging member may be configured such that the first engaging part and the second engaging part have widths greater than the width of the body part.

According to an embodiment, the string may be configured such that the one end of the string is coupled to the partition wall by at least one of a tape or a bond.

According to an embodiment, the second case may be configured such that at least a part of at least one edge of the second case includes a chamfer.

According to an embodiment, the second case may be configured such that the chamfer is formed on at least a part of the edge of the second case, with which the string is in contact with the string when the string moves by the part of the remainder thereof being pulled in a state in which the second case is inserted in the first case.

According to an embodiment, the chamfer shape may be formed by cutting at least a part of the thickness of the one surface at a position in which at least one surface of the second case is to be folded; and placing a coating material in at least a part of a cut area.

According to an embodiment, the second case may further include at least one retaining structure including at least one opening formed to allow the string to pass therethrough, and the at least one retaining structure may be disposed at a path which is in contact with the second case when the string moves by the part of the remainder thereof being pulled in a state in which the second case is inserted in the first case.

According to an embodiment, the second case may be configured such that at least one surface of the second case includes a curved surface convexly formed.

According to an embodiment, the second case may be configured such that at least one surface of the second case, which is in contact with the string when the string moves by the part of the remainder thereof being pulled in a state in which the second case is inserted in the first case, includes the curved surface.

According to an embodiment, the box may further include at least one additional case disposed in the remaining area of the first case.

According to an embodiment, the box may further include a retaining frame formed to correspond to an edge of the at least one additional case and disposed to retain the additional case.

According to an embodiment, the box may further include a third case including a seating part in which the first case is disposed, and a cover configured to extend from the seating part and formed to surround the first case.

According to an embodiment, the string may be disposed such that when a part of the string, which is exposed to the outside, is pulled in a state in which the second case is inserted in the first case, the string moves along a central axis of the second case.

As described above, an assembly process of a box (e.g., the box 10 FIG. 1) according to an embodiment may include a process of disposing a partition wall in an interior of a first case including the first opening in at least one surface thereof, a process of coupling a string to the partition wall, and a process of inserting a second case into the first case such that when the second case is inserted through the first opening of the first case, a part of the string is inserted into the first case, and a part of a remainder thereof is exposed outside of the first case.

According to an embodiment, the process of coupling of the string to the partition wall may include a process of disposing the string such that at least one engaging structure, which is disposed at one end of the string, is caught to the partition wall.

The invention claimed is:

1. A box comprising:

a first case comprising a first opening in at least one surface thereof;

a second case inserted into the first case through the first opening;

a partition wall configured to partition an interior of the first case into an area into which the second case is inserted and a remaining area; and a string which has one end coupled to the partition wall and which is configured such that when the second case is inserted into the first case, a part thereof is inserted into the first case and a part of a remainder thereof is exposed at an outside of the first case, wherein at least a part of the second case is withdrawn from the first case by the part of the remainder thereof being pulled in a state in which the second case is inserted in the first case.

2. The box of claim 1, wherein the string comprises at least one engaging structure disposed at the one end of the string, and the engaging structure is configured to be caught on the partition wall so that the string is coupled to the partition wall by the engaging structure.

3. The box of claim 2, wherein the partition wall comprises at least one second opening formed in one surface thereof, the at least one second opening being formed to have a size configured to allow the string to pass therethrough and not to allow the engaging structure to pass therethrough.

4. The box of claim 3, wherein the engaging structure has a lengthwise width greater than the lengthwise width of the at least one second opening.

5. The box of claim 3, wherein the at least one second opening is formed at a position closer to a surface, in which the first opening is formed, than a surface opposite to the surface in which the first opening of the first case is formed.

6. The box of claim 2, wherein the at least one engaging structure comprises an engaging member comprising:

a body part disposed at the one end of the string;

a first engaging part configured to extend from one end of the body part; and a second engaging part configured to extend from the other end of the body part.

7. The box of claim 6, wherein the engaging member is configured such that the first engaging part and the second engaging part have widths greater than the width of the body part.

8. The box of claim 1, wherein the string is configured such that the one end of the string is coupled to the partition wall by at least one of a tape or a bond.

9. The box of claim 1, wherein the second case is configured such that at least a part of at least one edge of the second case comprises a chamfer, the chamfer being formed on at least a part of the edge of the second case, with which the string is in contact when the string moves by the part of the remainder thereof being pulled in a state in which the second case is inserted in the first case.

10. The box of claim 9, wherein the chamfer is formed by:

cutting at least a part of a thickness of the one surface at a position in which at least one surface of the second case is to be folded; and placing a coating material in at least a part of a cut area.

11. The box of claim 1, wherein the second case further comprises at least one retaining structure comprising at least one opening formed to allow the string to pass therethrough, and the at least one retaining structure is disposed at a path which is in contact with the second case when the string moves by the part of the remainder thereof being pulled in a state in which the second case is inserted in the first case.

12. The box of claim 1, wherein the second case is configured such that at least one surface of the second case includes a curved surface convexly formed.

13. The box of claim 12, wherein the second case is configured such that at least one surface of the second case, which is in contact with the string when the string moves by the part of the remainder thereof being pulled in a state in which the second case is inserted in the first case, includes the curved surface.

14. The box of claim 1, further comprising at least one additional case disposed in the remaining area of the first case.

15. The box of claim 14, further comprising a retaining frame formed to correspond to an edge of the at least one additional case and disposed to retain the additional case.

16. The box of claim 1, further comprising a third case comprising:

a seating part in which the first case is disposed; and a cover configured to extend from the seating part and formed to surround the first case.

17. The box of claim 1, wherein the string is disposed such that when a part of the string, which is exposed to the outside, is pulled in a state in which the second case is inserted in the first case, the string moves along a central axis of the second case.

18. A box assembly process comprising:

disposing a partition wall in an interior of a first case comprising a first opening in at least one surface thereof;

coupling a string to the partition wall; and inserting a second case into the first case such that when the second case is inserted through the first opening of the first case, a part of the string is inserted into the first case, and a part of a remainder thereof is exposed outside the first case.

19. The box assembly process of claim 18, wherein the coupling of the string to the partition wall comprises disposing the string such that at least one engaging structure, which is disposed at one end of the string, is caught to the partition wall.

20. An enclosure for an electronic device, the enclosure comprising:

a first case defining a first opening;

a second case insertable into the first case through the first opening;

a partition wall configured to partition an interior of the first case into an area into which the second case is inserted and a remaining area; and a string coupled to the partition wall and configured such that, when the second case is inserted into the first case, a string part is inserted into the first case and a remaining string part is exposed at an outside the first case, wherein at least a part of the second case is withdrawn from the first case by the remaining string part being pulled in a state in which the second case is inserted in the first case.

* * * * *